United States Patent [19]

Drach

[11] 4,423,529

[45] Jan. 3, 1984

[54] DEVICE FOR RETAINING AND DRAINING KITCHEN ARTICLES

[76] Inventor: Edward Drach, 275 McLean Ave., Yonkers, N.Y. 10705

[21] Appl. No.: 264,702

[22] Filed: May 18, 1981

[51] Int. Cl.[3] ..... A47L 19/02

[52] U.S. Cl. ..... 4/656; 4/637

[58] Field of Search ..... 4/637, 656; 211/41, 211/126; 220/18, 19; D32/55, 56, 57; 34/238; 68/233

[56] References Cited

U.S. PATENT DOCUMENTS

| | | | |
|---|---|---|---|
| D. 187,856 | 5/1960 | Timmons | D32/57 |
| D. 215,170 | 9/1969 | Bachand | D32/55 |
| 2,629,498 | 2/1953 | Marasigan | 211/41 |
| 2,931,514 | 4/1960 | Hughes | 211/41 |
| 2,936,898 | 5/1960 | Miguez | 211/41 |
| 3,027,041 | 3/1962 | Stansbury et al. | 211/41 X |
| 3,417,875 | 12/1968 | Barker | 211/126 |
| 4,053,954 | 10/1977 | Chapman | 220/19 X |

FOREIGN PATENT DOCUMENTS

| | | | |
|---|---|---|---|
| 917304 | 1/1947 | France | 4/656 |

*Primary Examiner*—Charles E. Phillips
*Attorney, Agent, or Firm*—James & Franklin

[57] ABSTRACT

The device is designed to be mounted at the rear of the sink. A surface, supported at an incline towards the sink, has a recess adapted tor receive a single control-type faucet such that the device extends behind and around the faucet. The front portion of the device extends into the interior of this sink. Structure for mounting various kitchen articles are mounted on the surface. Drainage ports are provided in the surface to permit drainage into the sink. A movable towel rod is mounted to the device. Provision is made to accommodate a spray nozzle.

10 Claims, 9 Drawing Figures

DEVICE FOR RETAINING AND DRAINING KITCHEN ARTICLES

The present invention relates to a device for retaining and draining kitchen articles and, more particularly, to a device for retaining and draining kitchen articles which is designed to be mounted at the rear of a sink, at least partially behind and surrounding a faucet.

Devices for retaining and draining kitchen articles have heretofore been designed to be situated on a counter top, adjacent the side of a sink, or in the interior of the sink itself. The devices designed for counter top use typically include a substantially planar surface which may have ribs or drainage channels upon which kitchen articles can be placed. The surface is supported at an incline to cause liquid to drain into the sink. Often, the edge of the surface designed to be adjacent the rim of the sink is provided with a downwardly extending lip, over which the draining liquid flows, in order to facilitate the flow of liquid into the interior of the sink. The surface may be provided with structure for retaining various types of kitchen articles thereon. This structure may be integral or removable.

Devices designed for use in the sink often comprise a basket-like structure for retaining kitchen articles. The structure is held above the surface of the sink bottom by supports and permits drainage, through openings in the bottom of the structure, directly out to the sink bottom.

If the counter top type device is not provided with article retaining structure as a part thereof, the devices designed for use in the sink often may be used in combination therewith. This is accomplished by situating the basket-like structure on the planar surface. In this way, the articles are retained, by the basket-like structure, and liquid drains therefrom onto the inclined planar surface and runs along the planar surface into the sink.

The devices for retaining and draining kitchen articles described above for use on the counter top function adequately, but require a large amount of space and, therefore, cannot be utilized unless sufficient counter space is available alongside the sink. Even if sufficient counter space is available, when the device is positioned alongside the sink, this counter space which is occupied cannot be used for other purposes. Furthermore, such devices require a relatively large amount of storage space when not in use.

There are, however, many situations in which kitchen space is at a premium and sufficient counter top area alongside of a sink simply does not exist or must remain available for other purposes. Thus, devices designed for positioning alongside of the sink cannot be used. The lack of counter space may result from physical obstructions, for instance, a wall or an appliance, or may be due to the fact that counter space is so limited that the counter alongside the sink must be utilized for other more important purposes.

On the other hand, those devices designed for use in the sink normally occupy the entire sink. Thus, when same are in use, the sink cannot be utilized for other purposes.

Many sinks are provided with movable nozzles, connected to the water supply by a flexible hose. Such nozzles permit one to spray water into the sink when washing dishes or the like. The nozzles may be mounted on the base of the sink faucet or may be mounted on the surface of the sink upon which the faucet base is mounted, but spaced to the side thereof. Any device designed for mounting behind and around the faucet would normally occupy the same space as the spray nozzle. Thus, the device must have provision to accept such a nozzle, or could not be used in a great many sink installations.

Often, an individual who is washing dishes or otherwise working at the sink, must remove jewelry, such as rings or a watch, when working at the sink, to protect same from water and soap. Such articles of jewelry are often placed alongside the sink and may be accidentally knocked into the sink, inadvertently sprayed or splashed with water, or simply forgotten. However, prior art devices for retaining and draining kitchen articles normally provide no facility for retaining jewelry articles or the like in a safe, dry place.

In addition, dish towels are often used in conjunction with the washing and drying operation. However, prior art devices for retaining and draining kitchen articles normally do not provide any structure which will permit the hanging of a dish towel, after same has been used, in a place where water dripping therefrom would be directed into the sink.

It is, therefore, a prime object of the present invention to provide a device for retaining and draining kitchen articles which is designed for mounting at the rear of a sink at least partially behind and around a faucet.

It is another object of the present invention to provide a device for retaining and draining kitchen articles which requires no counter space at the side of the sink.

It is another object of the present invention to provide a device for retaining and draining kitchen articles designed for use in conjunction with a sink having a single control type faucet.

It is another object of the present invention to provide a device for retaining and draining kitchen articles which is adapted to accommodate sinks having movable spray nozzles.

It is another object of the present invention to provide a device for retaining and draining kitchen articles which incorporates a platform upon which jewelry or similar articles can be safely stored.

It is another object of the present invention to provide a device for retaining and draining kitchen articles incorporating a movable and removable structure for supporting a dish towel or the like.

In accordance with the present invention, a device for retaining and draining kitchen articles, for use in conjunction with a sink having a faucet, is provided. The device comprises a surface having a section adapted to be located in a position remote from the interior of the sink, with the faucet interposed therebetween. Means, on the surface, are provided for permitting drainage of liquids from the surface into the sink. Means for supporting the surface at an incline towards the drainage means are provided, as are means on the surface for retaining kitchen articles thereon.

The surface has a substantially "U"-shaped configuration and, thus, defines a recess into which a faucet, preferably of the single control type, is adapted to be received. The surface comprises side sections, located between the interior of the sink and the section located at the rear of the faucet, which extend along the sides of the faucet.

A second surface is situated in a plane substantially parallel to the wall of the sink and extends from the parts on either side of the faucet. Means extending from the second surface are provided for spacing same from the sink wall. The drainage means, in the form of drainage ports, are located on the side sections, immediately adjacent the second surface, such that water collected on the sections of the inclined surface will exit same through the drainage ports and flow between the second surface and the sink wall and, thereafter, into the interior of the sink.

The section of the surface adapted to be situated directly behind the faucet is mounted in a plane above the plane of the side parts of the surface. This section is formed of upstanding members mounted above an inclined surface to provide drainage from the section to one of the side sections. The elevated section constitutes a platform upon which jewelry or the like may be safely stored. However, this platform may be utilized for other purposes, such as to store soap, steel wool, sponges or the like. For this reason, drainage from this platform to the side section is provided in case same is required.

The inclined surface has a rear wall extending therefrom in a generally vertical direction. A member for supporting a dish towel or the like is provided. Means are provided for movably mounting the member on the rear wall of the device. The mounting means comprises bifuricated means for resiliently engaging the wall and means for pivotally connecting the member and the bifuricated mounting means.

The device is adaptable for use with a sink having a spray nozzle. One side section further comprises an opening therein to accommodate the nozzle. Removable means are provided for covering the opening, when no nozzle is present.

The support means comprises means for supporting the inclined surface above the plane of the sink rim. This permits space below the device for the base of the faucet such that the faucet base does not obstruct the proper mounting of the device and bases of a variety of different shapes and sizes can be accommodated, thus enhancing the universality of the device.

To these and such other objects which may hereinafter appear, the present invention relates to a device for retaining and draining kitchen articles, as set forth in detail in the following specification and recited in the annexed claims, taken together with the accompanying drawings, wherein like numerals refer to like parts, and in which:

Figure 1:
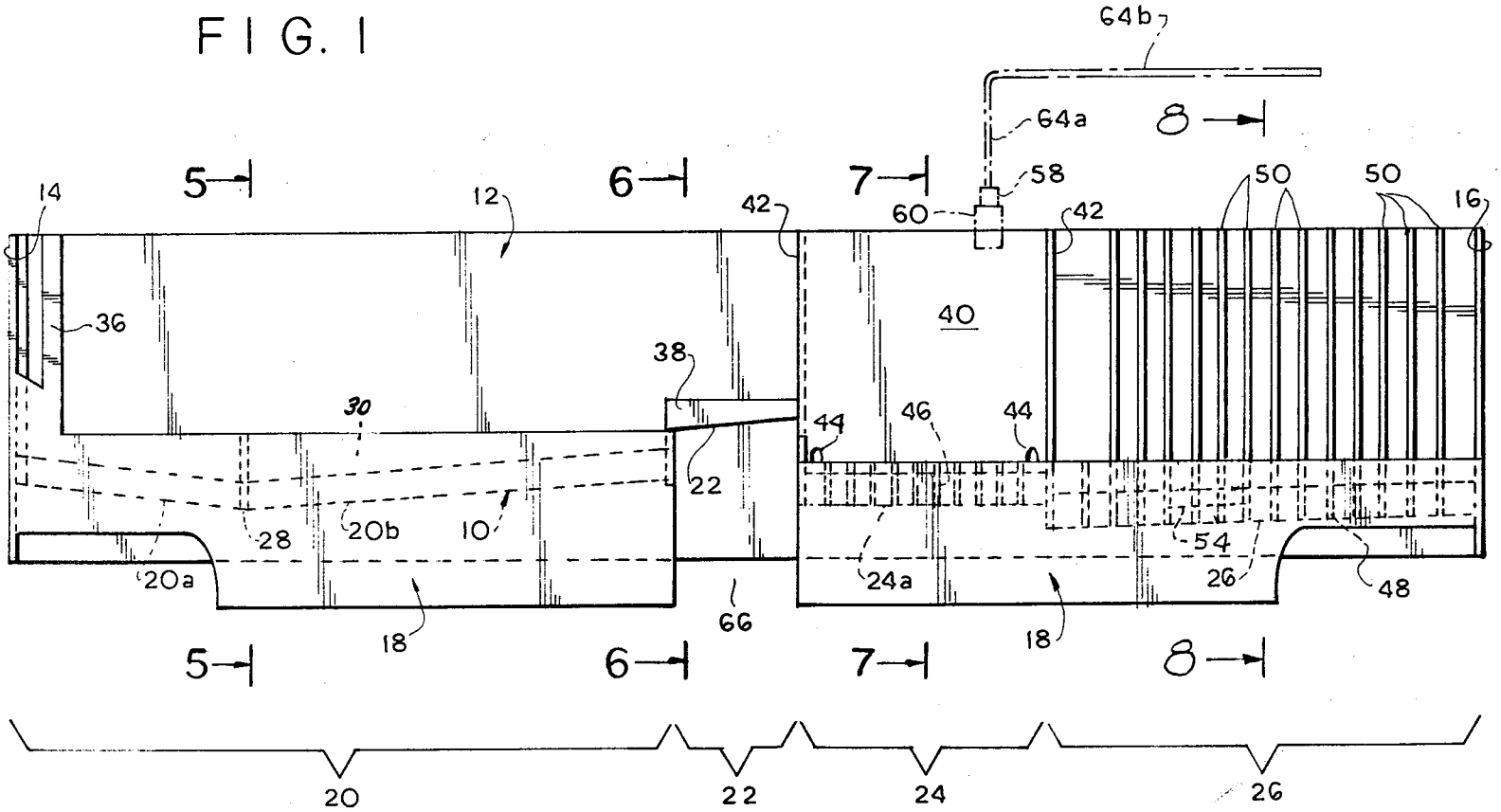
FIG. 1 is a front view of the device for retaining and draining kitchen articles of the present invention.
Figure 2:
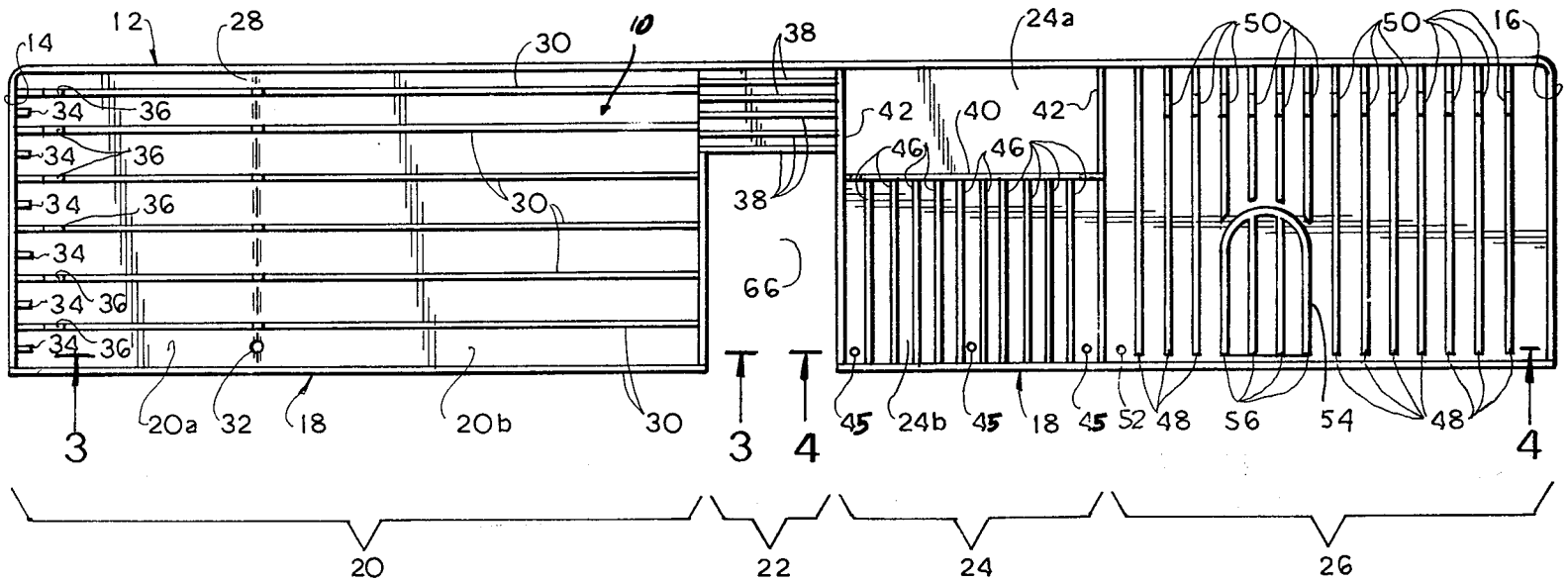
FIG. 2 is a top plan view of the device for retaining and draining kitchen articles of the present invention.
Figure 9:
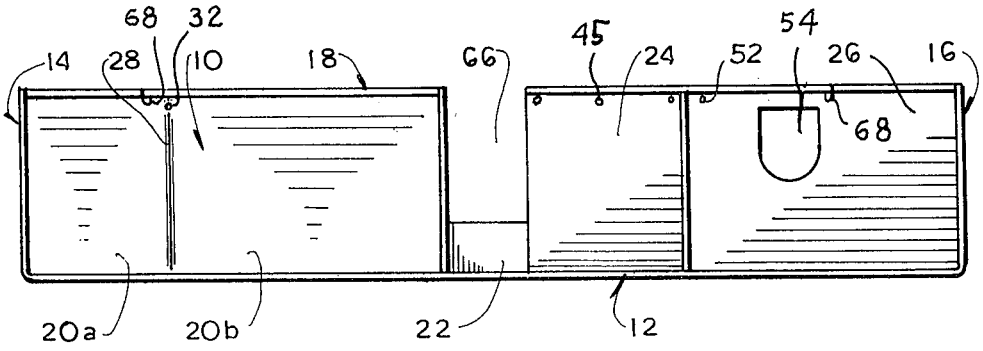
FIG. 9 is a bottom plan view of the device of the present invention.

As seen in the figures, and particularly FIGS. 1, 2 and 9, the device of the present invention comprises a surface, generally designated 10, inclined with respect to the horizontal, a substantially vertical rear surface, generally designated 12, a pair of substantially vertical side surfaces, generally designated 14 and 16, and a substantially vertical interrupted front surface, generally designated 18. Surface 10 has a generally "U"-shaped configuration and, for purposes of simplicity in description, can be divided into four separate sections 20, 22, 24 and 26, respectively.

Section 20 (left, as seen in FIGS. 1, 2 and 9) is affixed between rear wall 12 and front wall 18 at an incline towards front wall 18. Section 20 of surface 10 is itself divided into two portions 20*a* and 20*b*, along a channel 28. Each of the portions 20*a* and 20*b* are inclined towards channel 28. The top of each portion 20*a* and 20*b* is provided with a plurality of spaced, upstanding, dish retaining members 30. Members 30 divide portions 20*a* and 20*b* into a plurality of laterally extending compartments, each of which is adapted to receive a single dish and retain same in upstanding fashion.

Along channel 28, immediately behind front wall 18, is a drainage port 32. Each of the members 30 is provided with a vertical cut out portion, aligned with channel 28, such that liquid from the dishes mounted between members 30 drains along the respective portions 20*a* and 20*b* towards channel 28 and, thereafter, along channel 28 into drainage port 32. Extending inwardly from side wall 14, towards the interior of section 20*b*, are a plurality of rims 34, one of which is provided for each member 30. Ribs 34 are provided to engage the edges of the dishes mounted between members 30 to more securely retain the dishes in the proper position.

Figure 3:
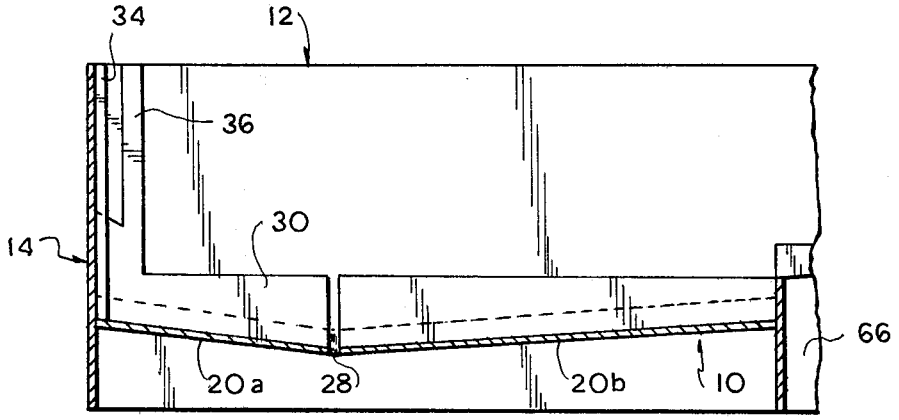
FIG. 3 is a cross-sectional view of the device for retaining and draining kitchen articles of the present invention, taken along line 3—3 of FIG. 2.

As best seen in FIGS. 1 and 3, each of the members 30 has an upwardly extending part 36 which is spaced a short distance from the interior surface of side wall 14. Members 36 are provided for receiving glassware or other articles thereon.

It should be noted that the top edge of each of the members 30 is substantially coplanar with the top edge of front wall 18 of section 20. These edges provide an interrupted, substantially horizontal surface upon which any article may be placed for temporary storage or drainage. Any liquid draining from such an article will drip onto the section 20 of surface 10 and, because of the incline thereof, thereafter towards port 32 and, thus, into the sink.

Section 22 of surface 10 is situated at an incline (from right to left, as seen in FIG. 1) such that the lower portion thereof is adjacent the rear corner of section 20*b* and substantially coplanar with the top edges of members 30. In this manner, any liquid situated on section 22 will flow into section 20*b* and, thereafter, drain through port 32.

A plurality of spaced, laterally extending members 38 are mounted in upstanding fashion on section 22. Each of the members 38 has a substantially horizontal top edge. The top edges of members 38 are substantially coplanar and create a horizontal platform which is elevated above the level of all other sections of surface 10. Members 38 are relatively close together such that even small objects may be situated on the platform formed by the top edges of members 38.

This platform is designed for temporary storage of jewelry or the like such that same can be situated in a relatively dry place, remote from the sink. Because the platform is situated immediately behind the faucet, the change of water being inadvertently splashed onto the platform is reduced, such that the platform is particularly well suited for retaining articles which should be kept dry. The platform is readily visible such that jewelry articles are less apt to be forgotten.

The platform can also be used to store other objects, such as soap, sponges, scouring pads, or the like. These objects will be kept dry and any water dripping therefrom will be drained into the sink.

Section 24 of surface 10, immediately adjacent section 22, is divided into two portions. The rear portion 24*a* is an upstanding utensil retaining compartment defined by a vertical front wall 40, a pair of side walls 42 and a rear wall 12. Walls 40 and 42 each have an upper edge which is coplanar with the upper edge of rear wall 12. The compartment 24*a* is tall enough such that kitchen utensils may be retained therein in a substantially vertical fashion.

The bottom surface of portion 24*a* is inclined towards portion 24*b* and the front wall 40 is provided with drainage ports 44 at the lower right and left hand corners thereof (as seen in FIG. 1) to permit drainage of liquid from portion 24*a* into portion 24*b*. Portion 24*b* is also inclined towards the front wall 18 and three spaced drainage ports 45 are provided, immediately behind front wall 18, to permit drainage from portions 24*a* and 24*b* through ports 45 and into the sink. A plurality of upstanding spaced members 46, which extend between walls 18 and 40, are provided to permit small articles to be retained in an upstanding fashion. In addition, the top edges of members 46 are coplanar and, thus, provide a horizontal surface upon which an article may be retained.

Section 26 of surface 10 is inclined towards front wall 18 and towards section 24. Mounted in spaced relation are a plurality of upstanding members 48, extending between rear wall 12 and a point spaced from front wall 18, so as to form a channel between members 48 and front wall 18. At the front of section 26 of surface 10, near section 24, is provided a drainage port 52. Liquid flows along section 26 towards the channel situated adjacent front wall 18 and then along the channel to port 52.

The top edges of members 48 are substantially coplanar with the top edges of members 46 of portion 24*b*. Members 48 are provided to permit articles, such as small plates, saucers and the like to be retained in upstanding relation on section 26.

Extending from each of the members 46, near the rear thereof and spaced from rear wall 12 is an upstanding member 50. Glasses, cups or the like may be mounted on members 50, such that liquid therein can drain onto portion 26 of surface 10.

As mentioned above, many sinks are provided with movable spray nozzles which are mounted on one side of the faucet, either on the base of the nozzle or spaced from the base of the nozzle on the rim of the sink itself. Thus, in order for the device of the present invention to be universally acceptable for mounting on all sinks, provision must be made for the spray nozzle. For this reason, section 26 of surface 10 is provided with an elongated part 54, extending from front wall 18 and having a rounded rear section. Part 54 is received within an opening in section 26 and is frictionally engaged by the surrounding surface portions. Upstanding members 56, mounted on the top surface of part 54, are substantially colinear with members 48.

Figure 4:
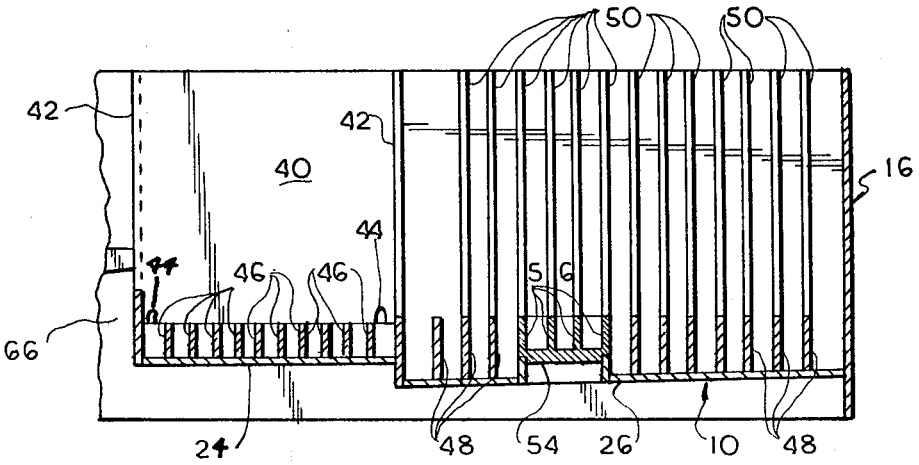
FIG. 4 is a cross-sectional view of a portion of the device of the present invention, taken along line 4—4 of FIG. 2.
Figure 5:
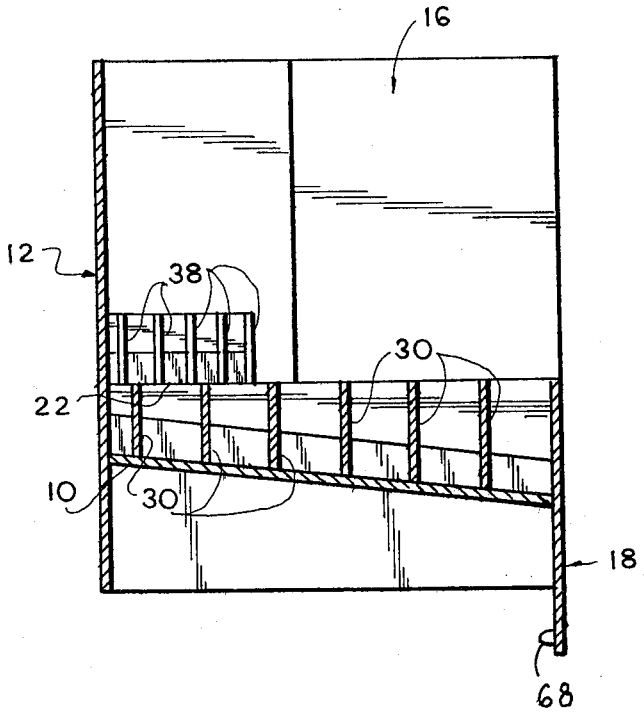
FIG. 5 is a cross-sectional view of a portion of the device of the present invention, taken along line 5—5 of FIG. 1.

In this manner, if no spray nozzle is present, part 54 remains within section 26 of surface 10, as shown in FIGS. 2 and 4, such that mounting of articles on and drainage from section 26 takes place as if section 26 and members 48 were uninterrupted. On the other hand, if the device is to be used in conjunction with a sink having a spray nozzle, part 54 is removed from section 26 of surface 10, by pushing upwardly on the underside of surface 10, such that when the device is placed over the sink the spray nozzle will extend up through the opening remaining in section 26 after the removal of part 54 therefrom.

It should be noted that part 54 is located at a position on the device which would align with a spray nozzle which was mounted on the rim of a sink spaced from the base of the faucet. However, as mentioned above, certain installations have the spray nozzle mounted on the base of the faucet itself. In order to accommodate this type of installation, another removable part (not shown) identical to part 54, may be provided on section 24*b* of surface 10 so as to be in alignment with spray nozzles mounted on the faucet base. Thus, either of the removable parts may be removed to accommodate the spray nozzle, depending upon its location. In the absence of the spray nozzle, both removable parts are retained on surface 10.

Figure 6:
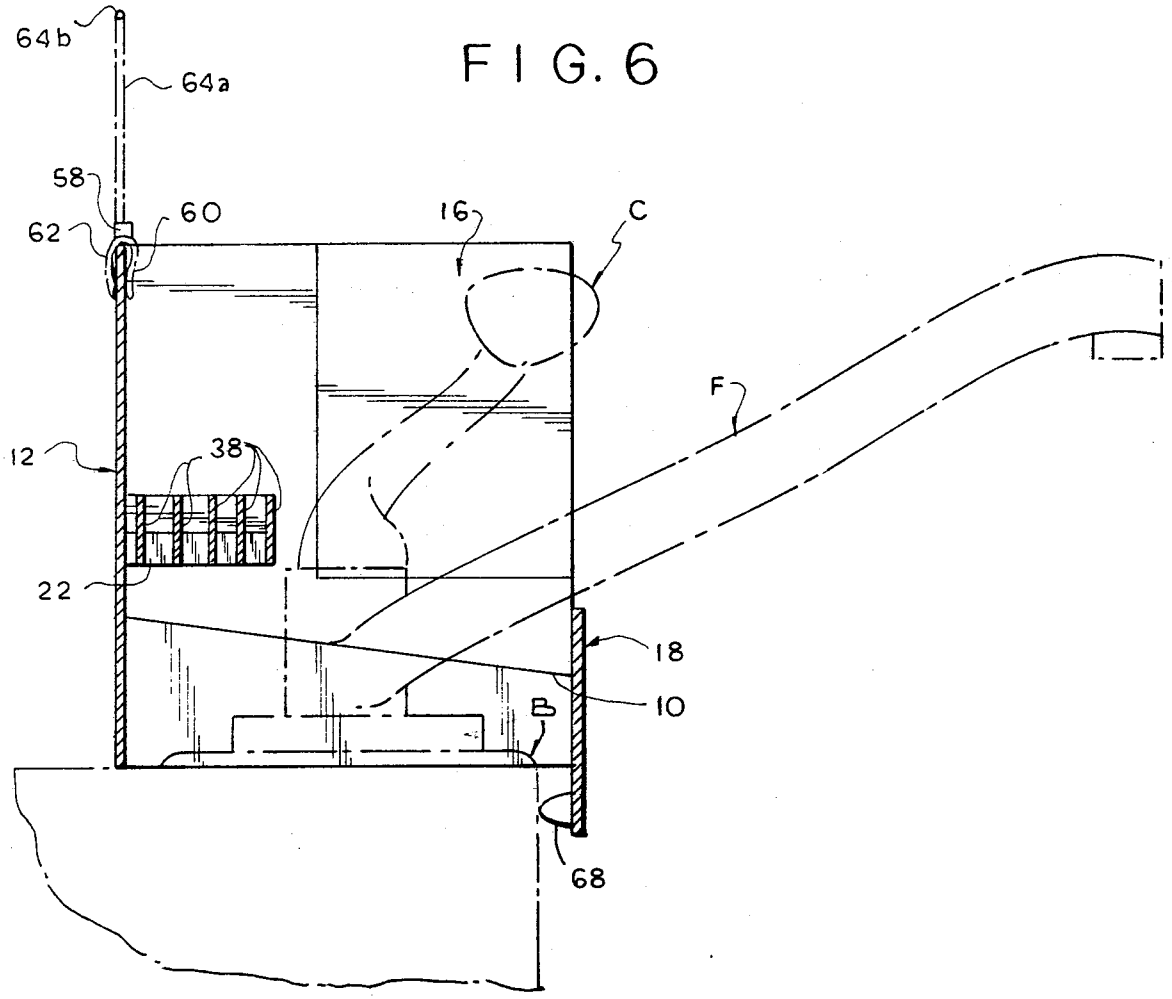
FIG. 6 is a cross-sectional view of a portion of the device of the present invention, taken along line 6—6 of FIG. 1.
Figure 7:
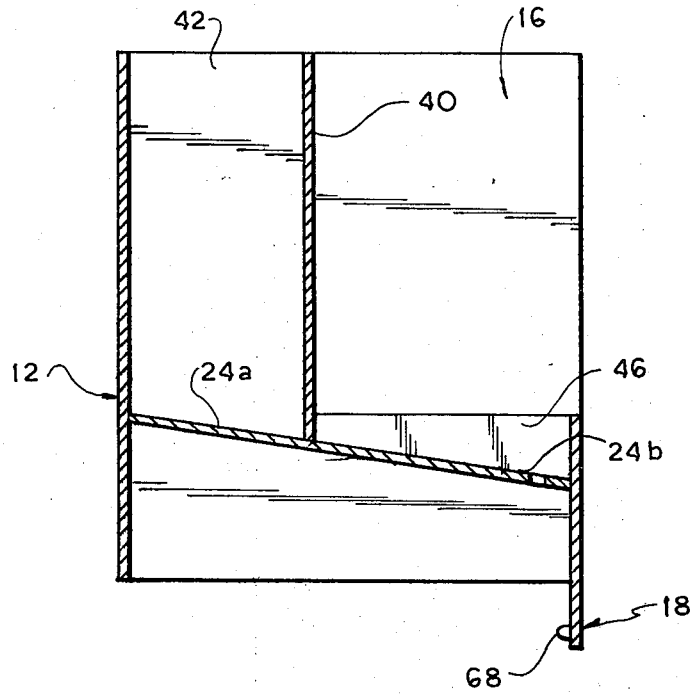
FIG. 7 is a cross-sectional view of a portion of the device of the present invention, taken along line 7—7 of FIG. 1.
Figure 8:
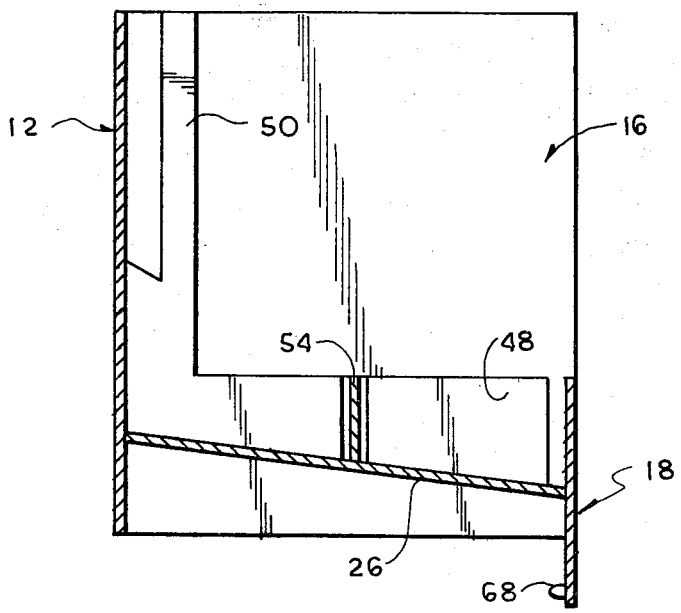
FIG. 8 is a cross-sectional view of a portion of the device of the present invention, taken along line 8—8 of FIG. 1.

As seen in FIGS. 1 and 6, a device for hanging dish towels or the like is provided for mounting on rear wall 12. The device comprises a bifuricated mounting part 58 having a pair of downwardly extending resilient members 60 and 62 which are biased towards each other. The top portion of rear wall 12 is frictionally engaged between members 60 and 62. Bifuricated mounting part 58 is structured such that it may be moved relative to the device and positioned anywhere along side walls 14 and 16 or rear wall 12 and may be removed when not in use.

Rotatably mounted to part 58 is a rod 64 having a vertical part 64*a* and a horizontal part 64*b*. Horizontal part 64*b* of rod 64 is adapted to permit a dish towel or the like to be hung therefrom. Because rod 64 is rotatably mounted to part 54, horizontal part 64*b* of rod 64 may be swiveled so as to place the same over any section of the device.

The manner in which the device of the present invention is mounted on a sink is illustrated in FIG. 6. As is obvious from FIG. 2, surface 10 is essentially "U"-shaped, defining a central recess 66 which is opened towards the front of the device. More specifically, section 20 of surface 10 defines one side of the recess and section 24 of surface 10 defines the other side of the recess. Sections 20 and 24 are separated by section 22 which defines the rear of the recess. Thus, when mounted on a sink, as seen in FIG. 6, sections 20 and 24 will be located on either side of the faucet, generally designated F, and section 22 will be situated behind faucet F. As mentioned above, faucet F is preferably of the type which has a single control, generally designated C, thereon such that there are no valves thereon to obstruct the space in which the device of the present invention is to be situated.

As can be seen in FIG. 6, most faucets F are mounted on a base B which is, in turn, mounted on the upper surface of the sink. In the present invention, all of the sections of surface 10 are situated well above the top surface of base B so as to provide clearance therefor. This is achieved by extending the lower edge of the rear wall 12 and side walls 14 and 16 downwardly, from surface 10, so as to provide a support for surface 10 well above the plane of base B and at an incline relative to the horizontal.

As also can be readily seen from FIG. 6, the lower portion of front wall 18 is provided with a plurality of inwardly extending protrusions 68. Protrusions 68 act to space the interior surface of front wall 18 of the device from the vertical wall of the sink. The space between front wall 18 and the wall of the sink is provided, such that water draining through ports 32, 45 and 52 will drain directly into the interior of the sink, instead of on the top of the sink near the rim. In this manner, drainage is introduced directly into the interior of the sink, without collecting on the sink rim.

It will now be appreciated that the present invention is a device for retaining and draining kitchen articles which is designed for mounting at the rear of a sink, at least partially behind and around a faucet. In this manner, the device requires no counter space at the side of the sink, permitting same to be used for other purposes. The device is preferably used in conjunction with a single control type faucet and may be adapted for use with sinks having movable spray nozzles, mounted either on the faucet base or on the sink itself.

The device includes a platform, elevated above all other horizontal surfaces of the device, upon which jewelry or similar articles may be temporarily stored in a dry place. In addition, a movable and removable structure for supporting a dish towel or the like is provided for use in conjunction with the device.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

I claim:

1. A device for retaining and draining kitchen articles, for use in connection with a sink having an interior recessed with respect to a generally planar exterior surface, and a faucet extending upward from said exterior surface, said device comprising first and second spaced, generally upstanding, side surfaces, each having a bottom edge adapted to rest on the exterior surface, a drainage surface mounted between said side surfaces at an incline towards the interior of the sink, and means situated on said drainage surface adapted to retain kitchen articles, said drainage surface comprising a recess adapted to receive said faucet therein and to permit same to at least partially extend above said drainage surface, a portion of said drainage surface being adapted to overhang the interior of the sink, said portion having a drainage port therein, a generally upstanding wall mounted to said portion of said drainage surface and adapted to partially extend below said drainage surface into the interior of the sink, means located on said upstanding wall for spacing said upstanding wall from the wall of the interior of the sink, said port being substantially aligned with the space between the sink wall and said upstanding wall so as to permit drainage from said drainage surface into the sink.

2. The device of claim 1, wherein said drainage surface comprises first and second portions inclined towards each other to form a drainage channel.

3. The device of claim 2, wherein said means for retaining kitchen articles comprises spaced upstanding members extending generally parallel to said upstanding wall and comprising cut-out portions aligned with said drainage channel.

4. The device of claim 3, further comprising upstanding means mounted on said drainage surface and adapted to retain glassware thereon.

5. The device of claim 4, wherein the top edge of said upstanding wall is substantially coplanar with the top edges of said upstanding members.

6. The device of claim 1, further comprising a generally upstanding rear surface and a second drainage surface situated between said rear and said recess.

7. The device of claim 6, wherein said second drainage surface is inclined so as to drain onto said drainage surface.

8. The device of claim 6, further comprising means extending above said second drainage surface and adapted to form a platform.

9. The device of claim 1, wherein the faucet has a base and further comprising means for supporting said drainage surface at a location spaced above the base of said faucet.

10. The device of claim 1, adapted for use with a sink having a spray nozzle located on one side of the faucet, wherein said drainage surface further comprises an opening therein adapted to accommodate the nozzle and removable means adapted to cover said opening.

* * * * *